US006536728B1

(12) United States Patent
Hagglund et al.

(10) Patent No.: US 6,536,728 B1
(45) Date of Patent: Mar. 25, 2003

(54) ADJUSTABLE KEYBOARD SUPPORT ASSEMBLY

(75) Inventors: Joel K. Hagglund, Oakdale, MN (US); Kenneth J. Kirchhoff, Gem Lake, MN (US); James E. Nash, Bloomington, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/947,732

(22) Filed: Sep. 6, 2001

(65) Prior Publication Data

US 2003/0042380 A1 Mar. 6, 2003

(51) Int. Cl.[7] ..... A47B 88/04

(52) U.S. Cl. ..... 248/286.1; 248/918; 248/291.1; 108/138; 108/143; 312/334.8

(58) Field of Search ..... 248/276.1, 278.1, 248/279.1, 286.1, 291.1, 918; 108/50, 72, 73, 137, 138, 143; 312/208, 322, 323, 334.4, 334.8, 334.14

(56) References Cited

U.S. PATENT DOCUMENTS 5,213,401 A 5/1993 Hatcher 5,294,087 A * 3/1994 Drabczyk et al. ..... 248/639

* cited by examiner

*Primary Examiner*—Leslie A. Braun
*Assistant Examiner*—Deborah M. Brann
(74) *Attorney, Agent, or Firm*—Michaele A. Hakamaki; George W. Jonas

(57) ABSTRACT

An adjustable keyboard support assembly, which generally includes a housing comprising a first side panel having a first guide rail system and a second side panel spaced from the first side panel and having a second guide rail system. The assembly further includes a generally U-shaped member comprising a support member with first and second ends, a first side arm attached to the first guide rail system and extending from the first end of the support member, wherein the first side arm comprises at least one notch, and a second side arm attached to the second guide rail system and extending from the second end of the support member, wherein the second side arm comprises at least one notch. The first and second side arms have rotatable and slideable connections with the guide rail system of their respective side panels. A keyboard platform is rotatably attached to the support member of the U-shaped member. A first latching member extends from the first side panel for engagement with the at least one notch of the first side arm, and a second latching member extends from the second side panel for engagement with the at least one notch of the second side arm.

17 Claims, 8 Drawing Sheets

ADJUSTABLE KEYBOARD SUPPORT ASSEMBLY

TECHNICAL FIELD

The present invention relates to keyboard support assemblies. More particularly, the present invention provides a keyboard support assembly with height and tilt adjustment features.

BACKGROUND OF THE INVENTION

Workstations for computers and computer-related equipment typically include at least a computer monitor, a keyboard, and a mousing device. To conserve space and to provide the user with flexibility in positioning the keyboard and mousing device relative to the computer monitor, it is often desirable for the workstation to include a keyboard drawer or keyboard support assembly. While some devices that support keyboards must be mounted to the bottom side of a computer table, mobile keyboard support assemblies may simply be placed on the top of a work surface, such as a desk, and typically include a housing on which the monitor is placed and an area under the housing for storage of the keyboard. The keyboard support assembly also typically includes a tray for supporting the keyboard and a mechanical connection that allows movement of the keyboard tray from its storage position within the housing when the keyboard is not in use to its open or extended position when the user wishes to use the keyboard.

Keyboard support assemblies may further include mechanical devices for moving the keyboard from its storage position to a position in front of the user that allows safe and comfortable operation of the keyboard. Because proper positioning of the keyboard can provide economic benefits to the user, various alternatives are available for adjusting both the keyboard height and keyboard angle. However, many of the known devices are awkward to adjust and may not provide the user with an adequate number of keyboard height and angle adjustment options to achieve the desired economic benefits. Thus, it is desirable to provide a keyboard support assembly that is easy to use and that gives the user a wide range of adjustment alternatives.

SUMMARY OF THE INVENTION

In one aspect of this invention an adjustable keyboard support assembly is provided, which generally includes a housing comprising a first side panel having a first guide rail system and a second side panel spaced from the first side panel and having a second guide rail system. The assembly further includes a generally U-shaped member comprising a support member having opposite first and second ends, a first side arm attached to the first guide rail system and extending from the first end of the support member, wherein the first side arm comprises at least one notch, and a second side arm attached to the second guide rail system and extending from the second end of the support member, wherein the second side arm comprises at least one notch. The first and second side arms have rotatable and slideable connections with the guide rail system of their respective side panels. A keyboard platform is rotatably attached to the support member of the U-shaped member. In addition, a first latching member extends from the first side panel for engagement with the at least one notch of the first side arm, and a second latching member extends from the second side panel for engagement with the at least one notch of the second side arm. The adjustable keyboard support assembly may include a rigid U-shaped member.

In another aspect of the invention, an adjustable keyboard support assembly is provided, which generally includes a housing comprising a first side panel having a first guide rail system and a second side panel spaced from the first side panel and having a second guide rail system. The assembly further includes a generally U-shaped member comprising a support member having opposite first and second ends, a first side arm slideably and rotatably attached to the first guide rail system and extending from the first end of the support member, wherein the first side arm comprises at least one notch adapted to rest on a work surface, and a second side arm slideably and rotably attached to the second guide rail system and extending from the second end of the support member, wherein the second side arm comprises at least one notch adapted to rest on a work surface. A keyboard platform is rotatably attached to the support member of the U-shaped member. The support assembly may further comprise a generally L-shaped member extending between the first and second side panels, wherein the L-shaped member is adapted to receive the notches of the first and second side arms.

BRIEF DESCRIPTION OF THE DRAWINGS

The present invention will be further explained with reference to the appended Figures, wherein like structure is referred to by like numerals throughout the several views, and wherein.

DETAILED DESCRIPTION OF THE PREFERRED EMBODIMENTS

Figure 1:
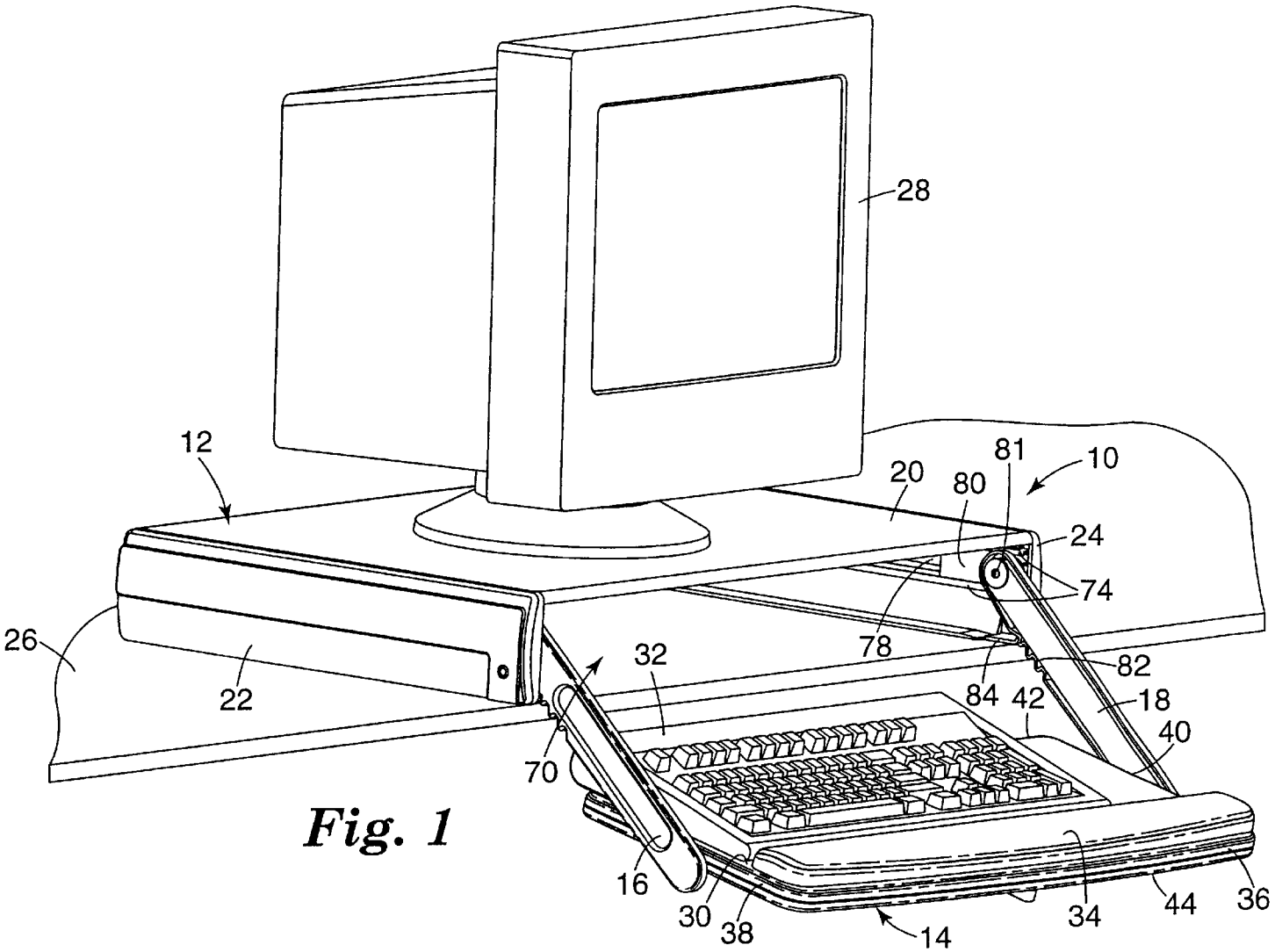
FIG. 1 is a perspective view of an adjustable keyboard support assembly of the present invention with the keyboard tray in an extended position.
Figure 2:
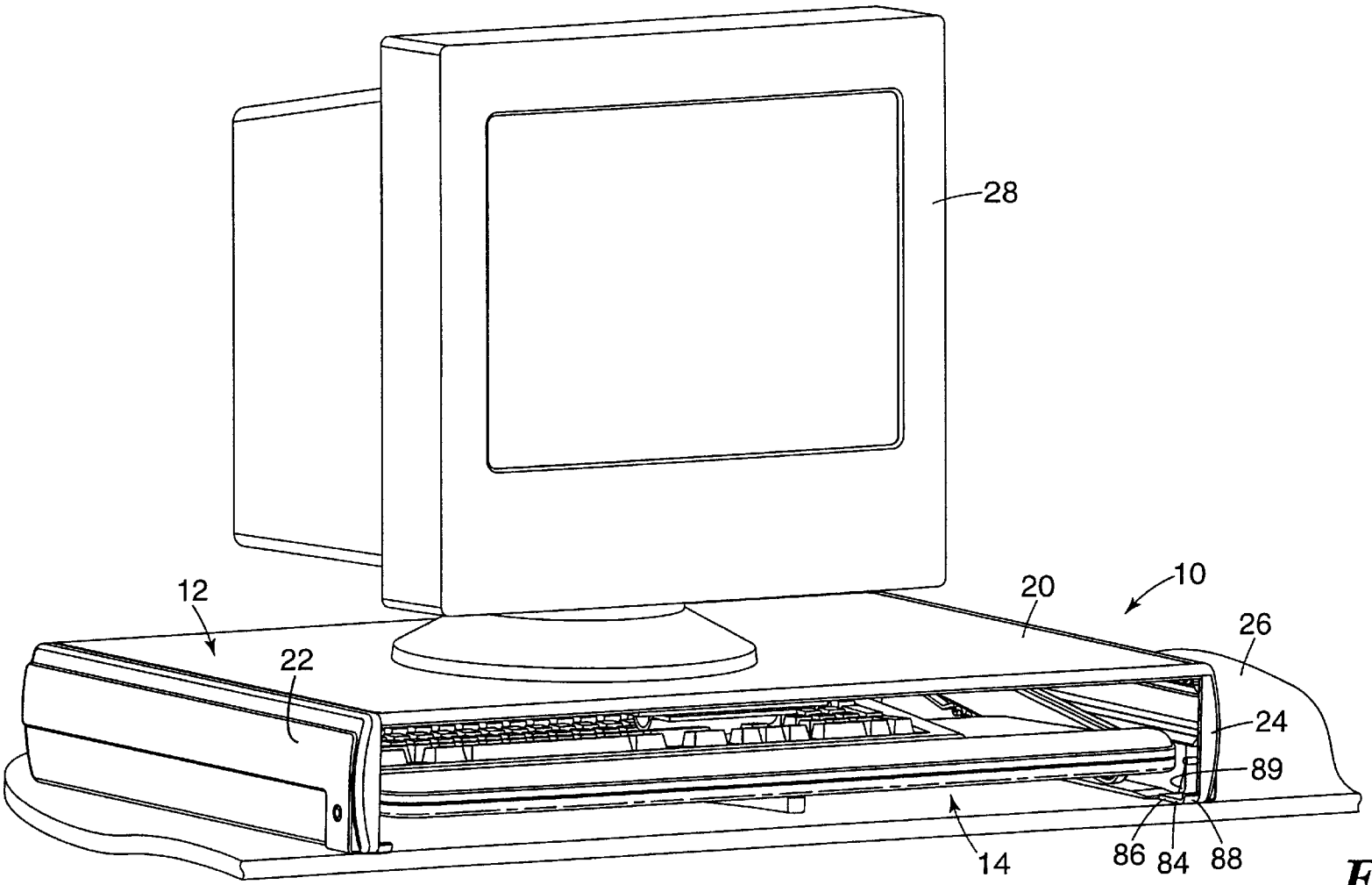
FIG. 2 is a perspective view of the adjustable keyboard support assembly of FIG. 1 with the keyboard tray in a retracted or storage position.

Referring now to the Figures, and initially to FIG. 1, one embodiment of an adjustable keyboard support assembly 10 of the present invention is illustrated in its extended or open position, which basic components comprise a housing 12 connected to a keyboard tray 14 by first side arm 16 and second side arm 18. FIG. 2 illustrates the keyboard support assembly 10 its retracted or storage position, where keyboard tray 14 is stored within housing 12. Housing 12 includes a planar support panel 20, a first side panel 22 extending generally downwardly from one end of panel 20, and a second side panel 24 extending generally downwardly from the opposite end of panel 20. First and second side panels 22, 24 may have the same general dimensions, and may be generally parallel to each other, as shown. Housing 12 may optionally further include a back panel (not visible)

extending generally downwardly from panel 20 and extending between the first and second side panels 22, 24.

One end of each side panel 22, 24 can contact the top of a work surface 26, such as a desk, when the keyboard support assembly 10 is positioned for use by a computer operator. In order to protect the work surface on which assembly 10 is placed and to prevent the assembly from sliding along the work surface, non-skid pads (not shown) may be affixed to the surface of the panels that contact a work surface. One example of a non-skid pad material that would be appropriate for such an application is commercially available from the Minnesota Mining and Manufacturing Company of St. Paul, Minn., under the trade designation "Bumpon". A computer monitor 28 can be positioned on the top surface of the planar support panel 20 for viewing by an operator. Thus, the housing 12 serves both as a support base for a computer monitor and as a storage drawer for the keyboard tray 14.

In order to support the weight of a computer monitor 28, the housing 12 must be made of a sufficiently strong material that resists bending and breaking. However, it is also important that the material chosen for the housing is relatively lightweight so that the keyboard support assembly 10 is not too heavy and awkward for the average user to move and position as desired. Examples of materials that may be used for the housing 12 include steel, wood, or plastics (e.g., high-impact polystyrene or polycarbonate), however, other materials or combinations of materials are also possible, depending on the desired strength and weight of the housing.

It is understood that any of the described embodiments for an adjustable keyboard support assembly of the invention may be mounted under a work surface rather than resting on the top of a work surface. If such an arrangement is desired, the planar support member could be directly mounted to the bottom of a work surface, or the planar support member could be eliminated and the side panels could be mounted to the bottom of a work surface.

Keyboard tray 14 has a top surface 30 that is generally flat for receiving a keyboard 32. Keyboard tray 14 is preferably large enough to accommodate any conventional keyboard, and is more preferably large enough to also provide a flat surface beyond one of the sides of a keyboard for manipulating a computer mouse. The top surface 30 may be smooth across its width, however, a portion or the entire top surface 30 may be textured with one or more texturing methods. For example, the area of the top surface 30 on which a keyboard will be placed may have a grooved or textured surface to minimize or prevent slippage of the keyboard, while the area of the top surface 30 on which a mouse will likely be used can be provided with a microstructured surface such as that material commercially available from the Minnesota Mining and Manufacturing Company of St. Paul, Minn., under the trade designation "Precise Mousing Surface". Any textured or smooth surfaces that are provided may be permanently affixed to or imbedded in the top surface 30, or may be removable from the top surface 30.

Top surface 30 is also preferably large enough to accommodate a wrist rest 34 along a front edge 36 of the keyboard tray 14 for cushioning the wrists of a person using the keyboard. The wrist rest 34 may extend across the entire front edge 36, or may extend only across a portion of the front edge 36. Many types of wrist rests would be appropriate, such as gel-filled wrist rests, foam wrist rests, and the like.

Keyboard tray 14 also includes first and second side edges 38, 40 on opposite ends of the front edge 36, and a back edge 42 generally opposite front edge 36. Keyboard tray 14 is preferably generally rectangular in shape, with each set of opposite edges parallel to each other, however, keyboard tray 14 may include at least one set of edges that are not parallel to each other, such as curvilinear edges or angled edges that may or may not be identical on opposite sides of the tray. Keyboard tray 14 may also include more or less than four edges, or may comprise a more irregular or curved shape that does not have distinct edges. A bottom surface 44 of tray 14 is the surface that is generally opposite top surface 30, where bottom surface 44 may be parallel to top surface 30, but may instead be at some other orientation relative to top surface 30. Further, the keyboard tray 14 is a multiple piece assembly in this embodiment, where one piece includes the top surface 30 and a separate piece includes the bottom surface 44, where these pieces are attached to each other during the assembly of the keyboard tray 14. Keyboard tray 14 may instead comprise only a single piece construction, or may comprise more than two pieces.

Figure 3:
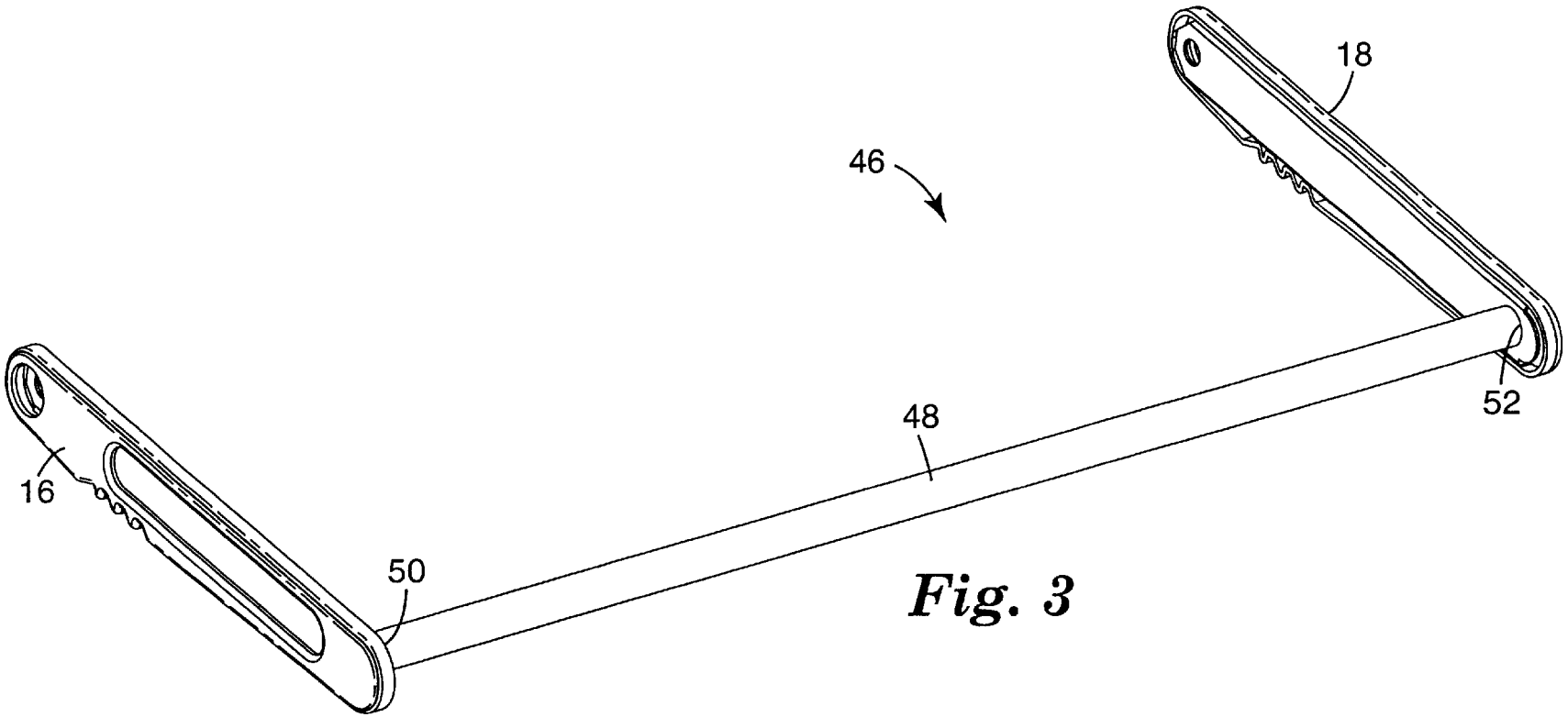
FIG. 3 is a perspective view of a U-shaped member of the adjustable keyboard support assembly of FIG. 1.
Figure 4:
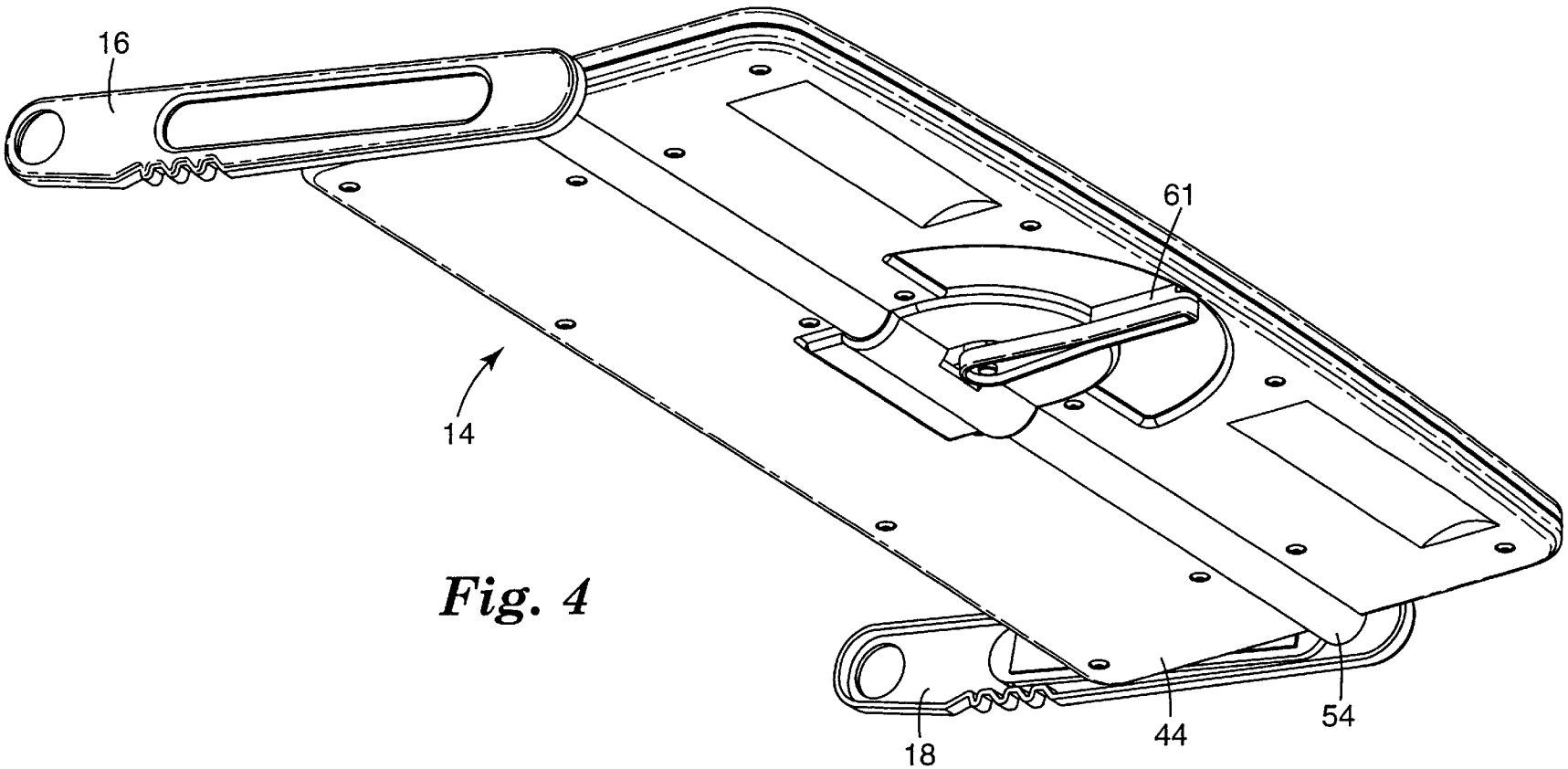
FIG. 4 is a bottom perspective view of the keyboard tray of FIG. 1.

FIG. 3 illustrates a generally U-shaped member 46, which comprises a support bar 48 having a first end 50 rigidly attached to side arm 16 and a second end 52 rigidly attached to side arm 18. Side arms 16, 18 of U-shaped member 46 are also shown in FIG. 4, which is a view from the bottom side of the keyboard tray 14. In this Figure, the support bar 48 of the U-shaped member 46 is not visible because it is enclosed between the pieces of the keyboard tray 14, however, the location of the support bar 48 is generally shown as a protruding area 54 from bottom surface 44.

Keyboard tray 14 of the present invention can preferably be rotated about the longitudinal axis of support bar 48, where the range of rotation may be 360 degrees about support bar 48, or may be limited to movement of less than 360 degrees by stops or other limiting methods or apparatuses. The range of rotation should be large enough to accommodate the particular application or environment in which the keyboard tray is being used. In addition, it is preferable that keyboard tray 14 have a locking mechanism to secure keyboard tray 14 to the position desired by the user.

Figure 5:
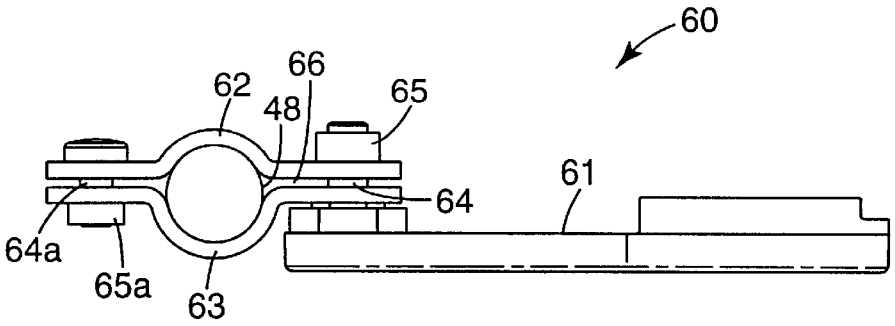
FIG. 5 is a side view of one embodiment of a locking assembly of the keyboard tray of FIG 4.

FIG. 5 illustrates one example of a locking mechanism 60, which basic components comprise a handle 61, a top clamp plate 62, and a bottom clamp plate 63. Handle 61 is also shown in FIG. 4, however, clamp plates 62, 63 are enclosed within keyboard tray 14 and are thus not visible in this Figure. Referring again to FIG. 5, one end of handle 61 is attached to one side of clamp plates 62, 63 with a screw 64 and self-clinching nut 65, such as the type of nut available from the Penn Engineering and Manufacturing Company of Danboro, Pa. under the trade designation "PEM Self-Clinching Nut". The generally opposite side of top clamp plate 62 is further attached to the generally opposite side of bottom clamp plate 63 with a screw **64*a* and self-clinching nut 65*a*. A portion of the length of support bar 48 is enclosed between top and bottom clamp plates 62, 63, with a gap 66 provided between the plates on either side of support bar 48. By rotating handle 61, top and bottom clamp plates 62, 63 are movable relative to each other to vary the size of gap 66 nearest screw 64 and nut 65. Nut 65*a* is tightened onto screw 64*a* during assembly of the locking mechanism 60 to provide a specific gap between plates 62, 63 in the area of screw 64*a* and nut 65*a***.

In operation, handle 61 can be rotated in a first direction that tightens nut 65 onto screw 64, which pulls plates 62, 63 closer to each other, thereby tightening the plates 62, 63 against support bar 48 along with narrowing the gap 66. Handle 61 can continue to be rotated in the same direction until the gap 66 is sufficiently small and support bar 48 is secured relatively tightly between plates 62, 63, so that keyboard tray 14 is essentially "locked" into place. To loosen or "unlock" keyboard tray 14 and allow its rotation, handle 61 is rotated in a second direction that is generally opposite to the first direction that locks the keyboard tray rotation. This movement loosens nut 65 so that plates 62, 63 can move apart from each other and loosen the plates 62, 63 from support bar 48, thereby widening the gap 66. Handle 61 can continue to be moved in the second direction until keyboard tray 14 can be rotated relatively freely about support bar 48. Alternatively, plates 62, 63 may be provided with a threaded hole through which the screws 64, 64*a* are threaded, so that nuts 65, 65*a* are unnecessary.

A wide variety of alternate arrangements are possible for rotation or angular adjustment of a keyboard tray relative to side arms. For one example, the handle of the above-described embodiment may be attached to top and bottom clamp plates with a circular plate or ring arrangement. In this arrangement, a circular plate at one end of the handle has a "stepped" profile and a mating circular plate on the bottom clamp plate has a corresponding "stepped" profile. When the handle is rotated, the circular plates rotate relative to each other, thereby changing the distance between clamp plates to lock or unlock the keyboard tray, as described above. For another example, the U-shaped member does not have a support bar extending the entire distance between the side arms. Rather, each side arm could comprise a circular shoulder portion extending from one side and toward the other side arm. In this example, the keyboard tray would include a support bar that is attached to the shoulder portions, thereby completing the U-shaped arrangement of components. Rotation or tilting of the keyboard tray in this embodiment could be controlled at one or both side arms, rather than with a locking mechanism under the keyboard tray.

Again referring to FIG. 1, the housing 12 further comprises an interior portion 70 in which the keyboard tray 14 can be stored when not in use and from which the keyboard tray 14 can be retracted when desired for keyboard use. The interior portion 70 includes a first pair or set of rails 72 (not visible) extending along at least part of the length of the first side panel 22 and projecting toward the interior portion 70. Each rail of the set of rails 72 is preferably parallel to the other rail, and may be positioned so that both rails are also parallel to the work surface 26, although they may instead be positioned at an angle relative to the work surface 26. Similarly, a second pair or set of rails 74 extend along at least part of the length of the second side panel 24 and project toward interior portion 70. Each of the rails of this pair of rails 74 may also be parallel or angled relative to work surface 26. In addition, the pair of rails 72 is preferably parallel to the pair of rails 74.

Each of the rails of the set of rails 72, 74 may be continuous, however, the rails 72, 74 may instead comprise more than one rail section along the length of side panels 22, 24. These rail sections may have gaps between them. Each set of rails 72, 74 is shown as the outwardly projecting portions of a single C-shaped piece attached to the interior side of panels 22, 24, however, the rails may instead be integrally formed slots in the panels 22, 24, or may have some other configuration than that shown. The area between the pair of rails 74 defines a channel 78 for receiving and retaining a sliding member 80. In the illustrated embodiment, sliding member 80 is a generally rectangular plate that has a shape and size that allow it to be captured between both rails, yet allow it to slide relatively easily along the length of the rails in a linear motion. Alternatively, sliding member 80 could have another shape, such as circular, oval, or any other shape which could be received by a corresponding rail system. Because the pair of rails 74 and their configuration within the housing 12 are generally the same as the pair of rails 72 and their configuration within the housing 12, the above description of rails 74 also applies to rails 72. However, it is contemplated that the pairs of rails 72, 74 could be different from each other, as long as the differences in the rails allow consistent motion of both sides of the U-shaped member 46 relative to the housing 12.

The above description includes a pair of rails on each side panel, however, it is understood that a rail system of the present invention could comprise a single rail or more than two rails. If a rail system having more or less than two rails is used, the slide member used would need to be adapted for sliding on such a rail system. For example, if each of the first and second side panels include only a single longitudinal rail, the slide member could include a roller that is designed to roll along the length of the rail.

Keyboard support assembly 10 comprises side arms 16, 18 that are preferably essentially mirror images of each other such that the following description of side arm 18 also applies to side arm 16. Side arm 18 is connected to sliding member 80 at a pivot point 81, as best illustrated in FIGS. 6*a* through 6*d*. The pivotal connection could be accomplished, for example, with a screw and washer arrangement. In this embodiment, side arm 18 includes four notches 82*a* through 82*d*. A latching member 84 is also illustrated in these Figures as a generally J-shaped member having a straight portion 86 and a hook portion 88. Latching member 84 is also illustrated in FIGS. 1 and 2 as a plate mounted to side panel 24, where member 84 includes a mounting portion 89 for attaching member 84 to side panel 24, along with straight portion 86 and hook portion 88 described above. As shown, straight portion 86 is generally parallel to work surface 26, and both portions 86, 88 extend in a generally perpendicular direction from mounting portion 89.

Figure 6A:
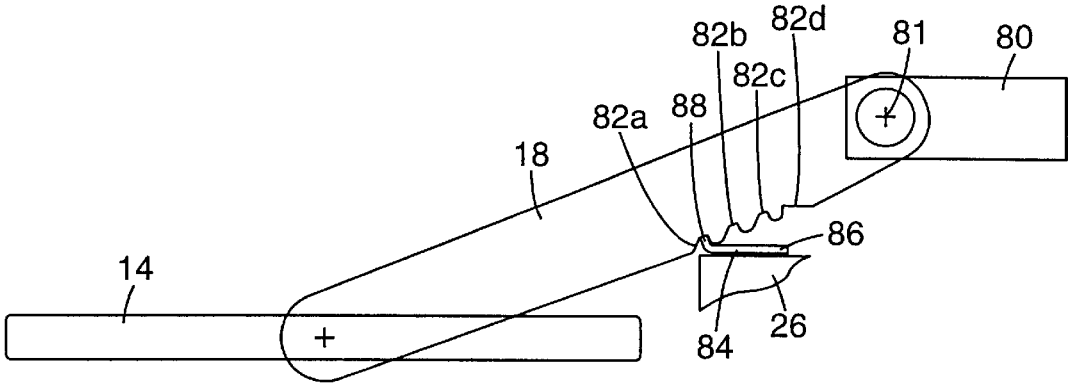
FIG. 6*a* through 6*d* are schematic views of four positions of one side arm and keyboard tray relative to a sliding member.
Figure 6B:
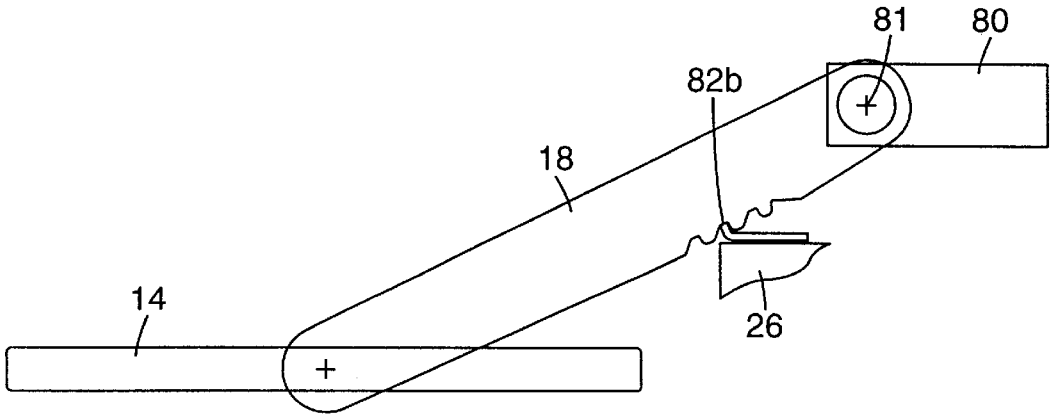
Figure 6C:
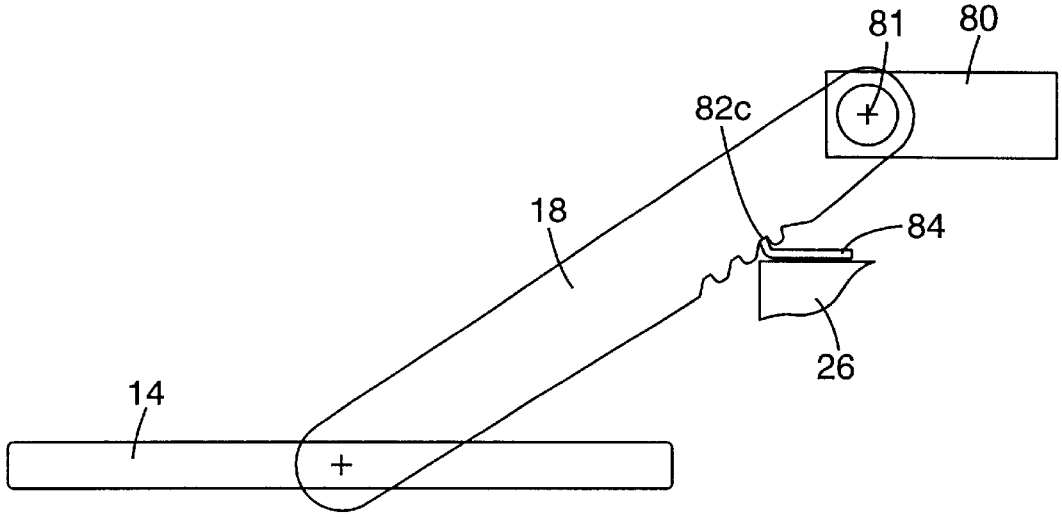
Figure 6D:
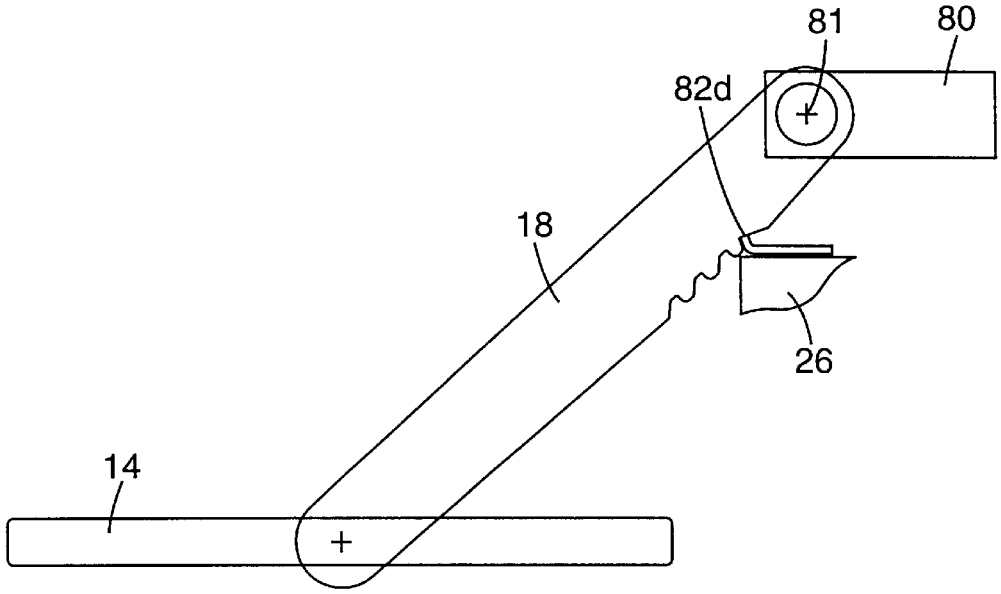

Referring again to FIGS. 6*a* through 6*d*, the shape, size, and position of notches 82*a* through 82*d* are designed to engage with hook portion 88 of latching member 84. FIG. 6*a* illustrates hook portion 88 engaged with a first notch 82*a*, which is the notch positioned furthest from sliding member 80 on arm 18. When hook portion 88 is engaged with this notch 82*a*, the keyboard tray 14 is positioned at a first height relative to work surface 26. Engagement of hook portion 88 with each subsequent adjacent notch (indicated as notches 82*b* through 82*d*) positions keyboard tray 14 at increasing distances from work surface 26, as illustrated in FIGS. 6*b* through 6*d*. Thus, a user could position the keyboard tray 14 at a specific desired height relative to the work surface 26 by choosing the notch that corresponds with this height and engaging this notch with latching member 84.

A latching member used in accordance with the present invention may take any number of configurations, including the one described above. However, the latching member used is preferably designed to provide positive engagement with at least one notch in a corresponding side arm to prevent downward movement of the keyboard tray relative to a work surface when pressure is applied to the surface of the keyboard tray. In addition, the latching member used is preferably selected to provide relatively easy disengagement with notches of the corresponding side arm to allow upward movement of the keyboard tray relative to the work surface by simply lifting or pushing the keyboard tray in an upward direction. In addition, although the above description includes a side arm having four notches, more or less notches can be provided in a particular side arm, where a greater number of notches provide the user with more options for the height of the keyboard tray relative to a work surface.

Referring again to FIGS. 1 and 2, FIG. 2 shows keyboard tray 14 in its storage position within housing 12. In order to move keyboard tray 14 to its retracted or working position shown in FIG. 1, keyboard tray 14 can be grasped and pulled in a generally parallel direction to the work surface and toward the user, where sliding members 80 would slide along their respective rails 72, 74 until the keyboard tray 14 is sufficiently removed from housing 12 to allow its movement in a vertical direction. The keyboard tray 14 can then be supported by a user's hand to control vertical movement, while allowing side arms 16, 18 to rotate about their respective pivot points 81 as the keyboard tray 14 is lowered to its desired height relative to work surface 26. At this point, the hook portion 88 of each latching member 84 can be engaged with the notch 82 in the corresponding side arm 16, 18 to maintain the keyboard tray 14 at this desired height. The keyboard tray 14 may then be rotated about support bar 48 to achieve the desired tilt of keyboard tray 14 relative to work surface 26 and the user.

The steps described above would basically be reversed to store keyboard tray 14 in housing 12, where keyboard tray 14 can be lifted or pushed upward to disengage each latching member 84 from the notch 82 in its corresponding side arm 16, 18. Side arms 16, 18 can rotate about their respective pivot points 81 as tray 14 continues to be lifted or pushed in an upward or generally vertical direction, until tray 14 is generally in the same plane as the opening in housing 12. Keyboard tray 14 can then be pushed forward so that sliding members 80 slide along their respective rails 72, 74 until keyboard tray 14 is enclosed within housing 12 for storage.

Figure 7:
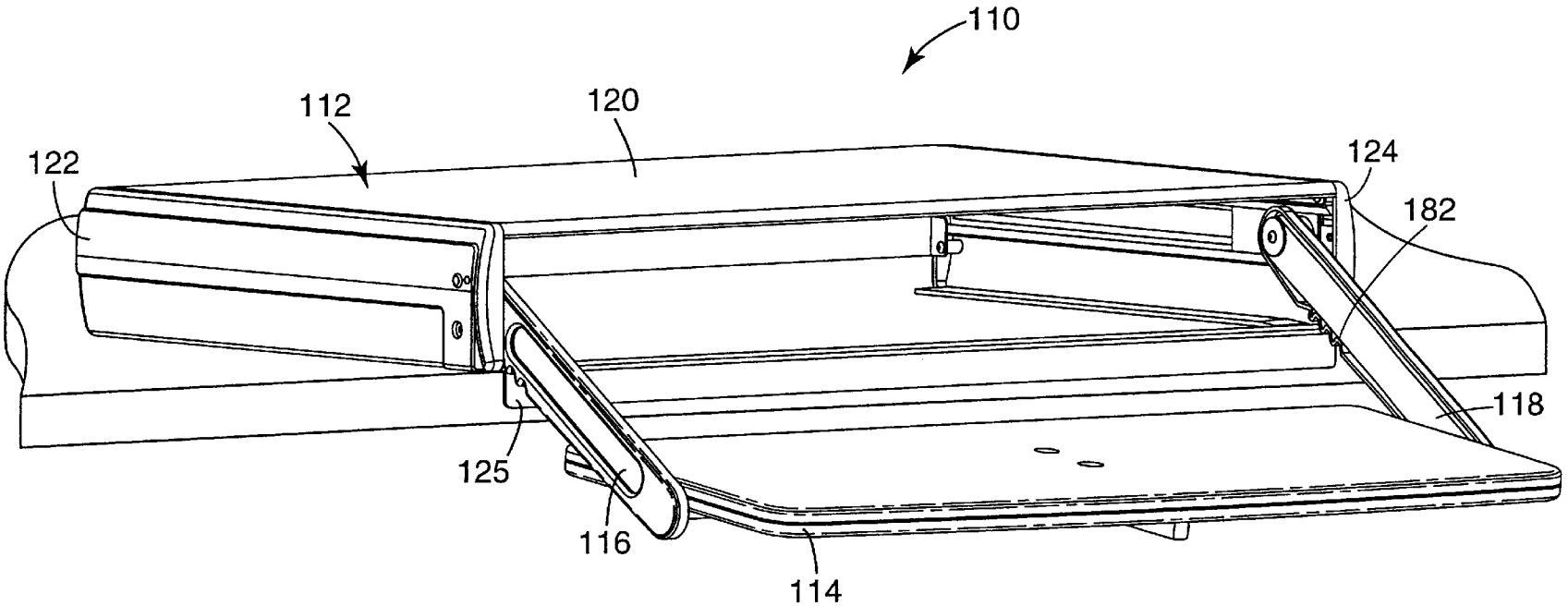
FIG. 7 is a perspective of another embodiment of an adjustable keyboard support assembly of the present invention.

FIG. 7 illustrates another embodiment of a keyboard support assembly 110, which components are similar to those described for assembly 10. However, assembly 110 does not have a latching member to engage with its side arms. Rather, assembly 110 includes a housing 112 having a planar support panel 120, a first side panel 122, a second side panel 124, and a generally L-shaped bracket 125 extending from side panel 122 to side panel 124. Alternatively, assembly 110 may include more than one L-shaped bracket section, where one bracket section extends from each side panel 122, 124 toward the other side panel 122, 124, with a space provided between the two bracket sections. In either case, L-shaped bracket 125 is preferably generally shaped to match the corner of the work surface on which assembly 10 will rest.

Assembly 110 further includes side arms 116, 118 that each have at least one notch 182. Each notch 182 is designed to rest on bracket 125 to maintain the desired height of a keyboard tray 114. L-shaped bracket 125 is designed to both provide stability to the housing 112 and to protect the work surface from potential damage caused by notches 182 resting on it. It is possible, however, to eliminate the L-shaped bracket 125 of FIG. 7 and allow the notches 182 to rest directly on the work surface when keyboard tray 114 is in an extended position.

Figure 8:
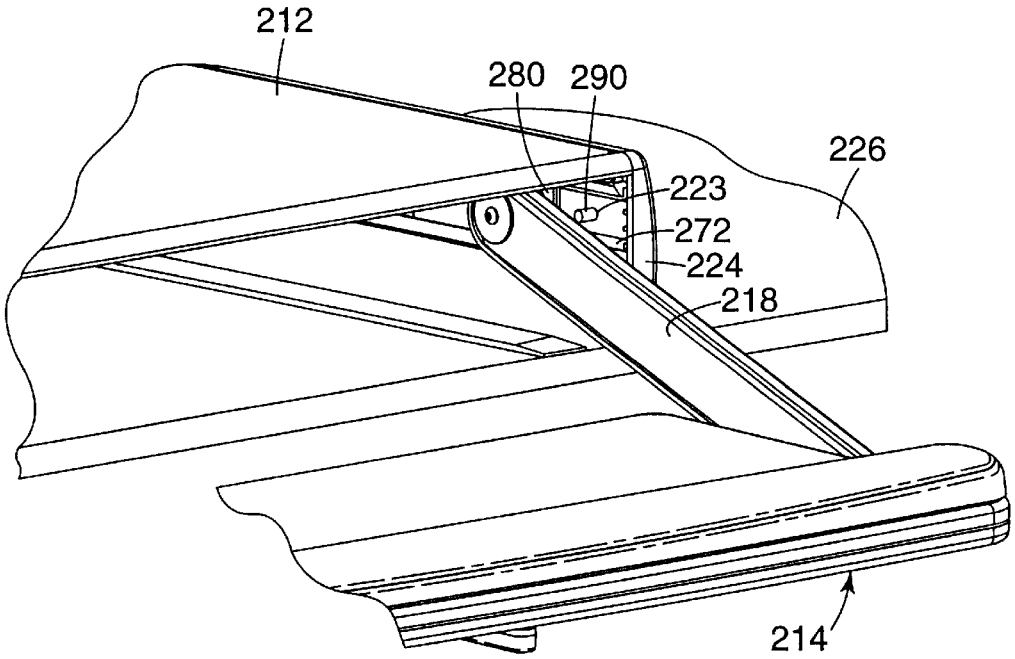
FIG. 8 is a partial perspective view of another embodiment of a keyboard support assembly.

FIG. 8 illustrates an alternative embodiment of a side arm 218 attached to a rail system 272 of a side panel 224. Side arm 218 can rotate and slide relative to rail system 272. As shown, side arm 218 does not include notches because such notches are not required by this embodiment. However, notches in the arm may also be included in accordance with the invention, which would essentially provide the user with more than one way of adjusting the height of a keyboard tray relative to a work surface 226. In this embodiment, side panel 224 is provided with at least one aperture 223 extending through the panel 224 in the general area of the rail system 272. In order to secure side arm 218 relative to a work surface, a keyboard tray 214 is moved by the user to a desired position, thereby placing a sliding member 280 in a certain position. A pin 290 is then inserted through aperture 223 until it extends into the interior area of housing 212, thereby preventing movement of a sliding member 280 in a linear direction along rail system 272, which in turn positions side arm 218 at a certain location and angle, while positioning keyboard tray 214 at a certain height relative to a work surface.

Further variations on the described embodiments are also contemplated by the present invention, including a keyboard support assembly that combines features of the various embodiments. One possible variation is that one arm of the U-shaped member is provided with notches for engagement with an L-shaped bracket, a latching member, a work surface, or some other device, while the other arm does not have any notches. Another possible variation is that one or both of the side arms (which may or may not include notches) are provided with one side of a hook and loop fastener, such as that commercially available from the Minnesota Mining and Manufacturing Company of St. Paul, Minn., under the trade designation "Dual Lock", while the surface with which the arm will come in contact (e.g., L-shaped member or work surface) is provided with the mating side of the hook and loop fastener. More specifically, the arm could be provided with the loop fabric of a hook and loop fastener while the surface with which the arm will come in contact could comprise hooks, or vice versa. When these surfaces contact each other, positive engagement between the arm and the surface it contacts will be achieved. To separate these surfaces, the arm would simply need to be pulled away from the surface it contacts. Alternatively, the arm and surface the arm contacts could be provided with intermeshing structured surfaces, magnetically attracted surfaces, textured surfaces, or other removable attachment means.

The present invention has now been described with reference to several embodiments thereof. The entire disclosure of any patent or patent application identified herein is hereby incorporated by reference. The foregoing detailed description and examples have been given for clarity of understanding only. No unnecessary limitations are to be understood therefrom. It will be apparent to those skilled in the art that many changes can be made in the embodiments described without departing from the scope of the invention. For instance, use of the keyboard platform to support devices and components other than those described are also contemplated. Thus, the scope of the present invention should not be limited to the structures described herein, but only by the structures described by the language of the claims and the equivalents of those structures.

What is claimed is:

1. An adjustable keyboard support assembly, comprising:

a housing comprising a first side panel having a first guide rail system, a second side panel spaced from the first side panel and having a second guide rail system;

a generally U-shaped member comprising:

a support member having opposite first and second ends;

a first side arm slideably and rotatably attached to the first guide rail system and extending from the first end of the support member, wherein the first side arm comprises at least one notch; and a second side arm slideably and rotably attached to the second guide rail system and extending from the second end of the support member, wherein the second side arm comprises at least one notch;

a keyboard platform rotatably attached to the support member of the U-shaped member;

a first latching member extending from the first side panel and adapted for engagement with the at least one notch of the first side arm; and a second latching member extending from the second side panel and adapted for engagement with the at least one notch of the second side arm.

2. The adjustable keyboard support assembly of claim 1, wherein the U-shaped member is rigid.

3. The adjustable keyboard support assembly of claim 1, wherein each of the first and second guide rail systems comprises at least one rail, wherein each rail of the first guide rail system is generally parallel to each rail of the second guide rail system.

4. The adjustable keyboard support assembly of claim 1, wherein each of the first and second guide rail systems comprises a pair of generally parallel guide rails.

5. The adjustable keyboard support assembly of claim 4, wherein the first side arm is slideably and rotatably attached to the first side panel with a first sliding member retained between the pair of guide rails of the first guide rail system and wherein the second side arm is slideably and rotatably attached to the second side panel with a second sliding member retained between the pair of guide rails of the second guide rail system.

6. The adjustable keyboard support assembly of claim 1, wherein the first side arm is slideably and rotatably attached to the first guide rail system with a first sliding member and the second side arm is slideably and rotatably attached to the second guide rail system with a second sliding member.

7. The adjustable keyboard support assembly of claim 1, wherein at least one of the first and second guide rail systems comprises a longitudinal slot.

8. The adjustable keyboard support assembly of claim 1, wherein each notch of the first and second side arms is shaped for positive engagement with the first or second latching member to limit downward movement of the U-shaped member when the first latching member is engaged with a notch of the first side arm and the second latching member is engaged with a notch of the second side arm.

9. The adjustable keyboard support assembly of claim 1, wherein the keyboard platform further comprises a locking device adapted to be engaged to inhibit rotation of the keyboard platform relative to the U-shaped member and to be disengaged to allow relatively free rotation of the keyboard platform relative to the U-shaped member.

10. The adjustable keyboard support assembly of claim 9, wherein the locking device comprises a handle extending from a bottom side of the keyboard platform, wherein rotation of the handle in a first direction tightens the locking device to inhibit rotation of the keyboard platform relative to the U-shaped member, and wherein the rotation of the handle in a second direction loosens the locking device to allow relatively free rotation of the keyboard platform relative to the U-shaped member.

11. The adjustable keyboard support assembly of claim 10, wherein the locking device further comprises a top clamp plate on one side of the support member, a bottom clamp plate on the opposite side of the support member, a screw, and a nut, wherein the screw and nut moveably attach the handle to the top and bottom clamp plates.

12. An adjustable keyboard support assembly, comprising:

a housing comprising a first side panel having a first guide rail system, a second side panel spaced from the first side panel and having a second guide rail system;

a generally U-shaped member comprising:

a support member having opposite first and second ends;

a first side arm slideably and rotatably attached to the first guide rail system and extending from the first end of the support member, wherein the first side arm comprises at least one notch adapted to rest on a work surface; and a second side arm slideably and rotably attached to the second guide rail system and extending from the second end of the support member, wherein the second side arm comprises at least one notch adapted to rest on a work surface; and a keyboard platform rotatably attached to the support member of the U-shaped member.

13. The adjustable keyboard support assembly of claim 12, further comprising a generally L-shaped member extending between the first and second side panels, wherein the L-shaped member is adapted to receive the at least one notch of the first and second side arms.

14. The adjustable keyboard support assembly of claim 12, wherein the U-shaped member is rigid.

15. An adjustable keyboard support assembly, comprising:

a housing comprising a first side panel having a first guide rail system, a second side panel spaced from the first side panel and having a second guide rail system, and at least one aperture through each of the first and second side panels;

a generally U-shaped member comprising:

a support member having opposite first and second ends;

a first side arm extending from the first end of the support member; and a second side arm extending from the second end of the support member;

a keyboard platform rotatably attached to the support member of the U-shaped member;

a first sliding member slideably and rotatably attached to the first guide rail system;

a second sliding member slideably and rotatably attached to the second guide rail system;

a first pin extending through the aperture of the first side panel, wherein the first pin prevents the first sliding member from moving in at least one direction relative to the first guide rail system; and a second pin extending through the aperture of the second side panel, wherein the second pin prevents the second sliding member from moving in at least one direction relative to the second guide rail system.

16. An adjustable keyboard support assembly, comprising:

a housing comprising a first side panel having a first guide rail system and a second side panel spaced from the first side panel and having a second guide rail system;

a generally U-shaped member comprising:

a support member having opposite first and second ends;

a first side arm slideably and rotatably attached to the first guide rail system and extending from the first end of the support member, wherein the first side arm comprises means for removable attachment of the first side arm to a surface; and a second side arm slideably and rotably attached to the second guide rail system and extending from the second end of the support member, wherein the second side arm comprises means for removable attachment of the second side arm to a surface; and a keyboard platform rotatably attached to the support member of the U-shaped member.

17. The adjustable keyboard support assembly of claim 16, further comprising at least one mating means for removable attachment of the first and second side arms to a surface.

* * * * *